US011024971B2

(12) United States Patent
Hong et al.

(10) Patent No.: US 11,024,971 B2
(45) Date of Patent: Jun. 1, 2021

(54) WIDEBAND MILLIMETER (MMWAVE) ANTENNA

(71) Applicant: The Board of Trustees of The University of Alabama, Tuscaloosa, AL (US)

(72) Inventors: Yang-Ki Hong, Tuscaloosa, AL (US); Woncheol Lee, Tuscaloosa, AL (US); Hoyun Won, Tuscaloosa, AL (US)

(73) Assignee: The Board of Trustees of The University of Alabama, Tuscaloosa, AL (US)

( * ) Notice: Subject to any disclaimer, the term of this patent is extended or adjusted under 35 U.S.C. 154(b) by 0 days.

(21) Appl. No.: 16/532,815

(22) Filed: Aug. 6, 2019

(65) Prior Publication Data

US 2020/0052403 A1 Feb. 13, 2020

Related U.S. Application Data

(60) Provisional application No. 62/716,003, filed on Aug. 8, 2018.

(51) Int. Cl.
*H01Q 9/04* (2006.01)
*H01Q 9/32* (2006.01)

(52) U.S. Cl.
CPC ..... *H01Q 9/045* (2013.01); *H01Q 9/0442* (2013.01); *H01Q 9/32* (2013.01)

(58) Field of Classification Search
CPC ..... H01Q 9/04; H01Q 9/045; H01Q 9/0442; H01Q 9/0457; H01Q 9/32; H01Q 9/40; H01Q 21/24; H01Q 21/065; H01Q 11/08
See application file for complete search history.

(56) References Cited

U.S. PATENT DOCUMENTS

| | | | | |
|---|---|---|---|---|
| 6,166,694 | A | 12/2000 | Ying | |
| 6,593,887 | B2 * | 7/2003 | Luk | H01Q 1/40 343/700 MS |
| 2006/0001574 | A1 * | 1/2006 | Petros | H01Q 9/0407 343/702 |
| 2009/0278746 | A1 * | 11/2009 | Aurinsalo | H01Q 9/0435 343/700 MS |
| 2010/0103049 | A1 * | 4/2010 | Tabakovic | H01Q 9/0457 343/700 MS |
| 2010/0194643 | A1 * | 8/2010 | Petros | H01Q 9/0457 343/700 MS |

(Continued)

OTHER PUBLICATIONS 5G frequency bands in India, USA, Europe, China, Japan, Korea 5G Bands On-line at: http://www.rfwireless-world.com/Tutorials/5G-frequency-bands.html , Apr. 25, 2017, 5 pages.

(Continued)

*Primary Examiner* — Thai Pham

(74) *Attorney, Agent, or Firm* — Meunier Carlin & Curfman LLC

(57) ABSTRACT

Described and disclosed herein is a wideband polarized patch antenna and the antenna array that can cover mmWave frequency band from 24.3 to 29.6 GHz for 5G applications, and a feeding structure for such an antenna comprising a single element of a polarized helical-shaped L-probe fed patch antenna (HLF-PA) package.

25 Claims, 5 Drawing Sheets
(4 of 5 Drawing Sheet(s) Filed in Color)

(56) References Cited

U.S. PATENT DOCUMENTS

2018/0102594 A1 4/2018 Murdock et al.

OTHER PUBLICATIONS

Liu et al., Antenna-in-Package Design Considerations for Ka-Band 5G Communication Applications. IEEE Transactions on Antennas and Propagation, vol. 65, No. 12, pp. 6372-6379, Dec. 2017.
Du et al., Dual-polarized Patch Array Antenna Package for 5G Communication Systems. 11th European Conference on Antennas and Propagation, Paris, 2017, pp. 3943-3496.
Gu et al., A Multilayer Organic Package with 64 Dual-Polarized Antennas for 28GHz 5G Communication. IEEE MTT-S International Microwave Symposium, Honolulu, HI, 2017, pp. 1899-1901.
Wu, Advanced Interconnect and Antenna-in-Package Design for Millimeter-wave 5G Communications. 18th International Conference on Electronic Packaging Technology, Harbin, 2017, pp. 17-19.
Guo et al., Stacked Patch Array in LTCC for 28 GHz Antenna-in-Package Applications. IEEE Electrical Design of Advanced Packaging and Systems Symposium, Haining, 2017, pp. 1-3.
Hong, et al., Grid Assembly-Free 60-GHz Antenna Module Embedded in FR-4 Transceiver Carrier Board. IEEE Transactions on Antennas and Propagation, vol. 61, No. 4, pp. 1573-1580, Apr. 2013.
Mak, et al., Experimental Study of a Microstrip Patch Antenna with an L-Shaped Probe. IEEE Transactions on Antennas and Propagation, vol. 48, No. 5, pp. 777-783, 2000.
Li, et al., A Dual-Feed Dual-Band L-Probe Patch Antenna. IEEE Transactions on Antennas and Propagation, vol. 53, No. 7, pp. 2321-2323, 2005.
Yang, et al., Wideband circularly polarized antenna with L-shaped slot. IEEE Transactions on Antennas and Propagation 56.6 (2008): 1780-1783.

* cited by examiner

WIDEBAND MILLIMETER (MMWAVE) ANTENNA

CROSS REFERENCE TO RELATED APPLICATION

This application claims priority to and benefit of U.S. provisional patent application Ser. No. 62/716,003 filed Aug. 8, 2018, which is fully incorporated by reference and made a part hereof.

BACKGROUND

Millimeter wave (mmWave), especially the frequency range from 24.25 to 29.5 GHz, has been allocated for 5G networks in many different countries. For example, the U.S. has 5G network frequency ranges between 26.5 and 28.35 GHz and between 37 and 40 GHz; South Korea has frequency ranges between 26.5 and 29.5 GHz; China has frequency ranges between 24.25 and 27.5 GHz and between 37 and 43.5 GHz; Europe has frequency ranges between 24.25 and 27.5 GHz; and Japan has frequency ranges between 27.5 and 28.28 GHz. Although mmWave-based communication can provide wide bandwidths, and thus a high data rate, the communication is limited by a high signal attenuation due to atmospheric absorption. Therefore, a high-gain phased array antenna with beamforming capability is needed. Also, antenna structure embedded within an integrated circuit (IC) package, namely antenna-in-package (AiP), instead of a discrete antenna is in high demand due to compactness, fabrication reliability, and cost-effectiveness. Hence, various mmWave phased array antennas using AiP design, which operate at 28 GHz frequency bands, have been widely investigated. The probe-fed dual-polarized patch antenna shows the 10-dB impedance bandwidth of 2.2 GHz (7.7%: 27.4-29.6 GHz). The height of antenna ($H_{ant}$) in AiP is 490 μm (0.045 $\lambda_L$ where $\lambda_L$ is the air wavelength of the lowest frequency in the operation band). To further improve impedance bandwidth of the phased array antenna, an air cavity structure was introduced into a dual-polarized aperture-coupled patch AiP. Thereby, the impedance bandwidth increased to 3.7 GHz (13%: 26.3-30 GHz). Also, the stacked patch antenna with a $H_{ant}$ of 540 μm (0.048$\lambda_L$) shows the impedance bandwidth of 4 GHz (14%: 26.5-30.5 GHz). However, the impedance bandwidth of the reported antennas is not broad enough to cover the allocated 5G frequency band within 28 GHz band.

Therefore, a wideband polarized patch antenna and the antenna array that can cover mmWave frequency band from 24.3 to 29.6 GHz for 5G applications is desired.

SUMMARY

Described and disclosed herein is a wideband polarized patch antenna and the antenna array that can cover mmWave frequency band from 24.3 to 29.6 GHz for 5G applications, and a feeding structure for such an antenna comprising a single element of a polarized helical-shaped L-probe fed patch antenna (HLF-PA) package. In some instances, the antenna is dual-polarized.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems. The patent or application file contains at least one drawing executed in color. Copies of this patent or patent application publication with color drawing(s) will be provided by the Office upon request and payment of the necessary fee:

FIG. 2A illustrates S-parameters and FIG. 2B illustrates realized gain at boresight;

FIG. 3A illustrates the XOZ-plane and FIG. 3B illustrates the YOZ-plane;

FIG. 5A illustrates frequency dependent isolation between different ports and FIG. 5B illustrates frequency dependent peak realized gain with different distance between adjacent elements;

FIG. 6A shows 2D radiation patterns at the XOZ-plane and FIG. 6B shows 2D radiation patterns at the YOZ-plane; FIGS. 7A and 7B show 2D radiation patterns at the XOZ-plane (FIG. 7A) and the YOZ-plane (FIG. 7B) and FIGS. 7C-7E show 3D radiation patterns with phase progressions of $\beta_X$=0° and $\beta_Y$=0° (FIG. 7C); $\beta_X$=120° and $\beta_Y$=0° (FIG. 7D); and, $\beta_X$=0° and $\beta_Y$=120° (FIG. 7E).

DETAILED DESCRIPTION

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes¬ from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

Figure 1A:
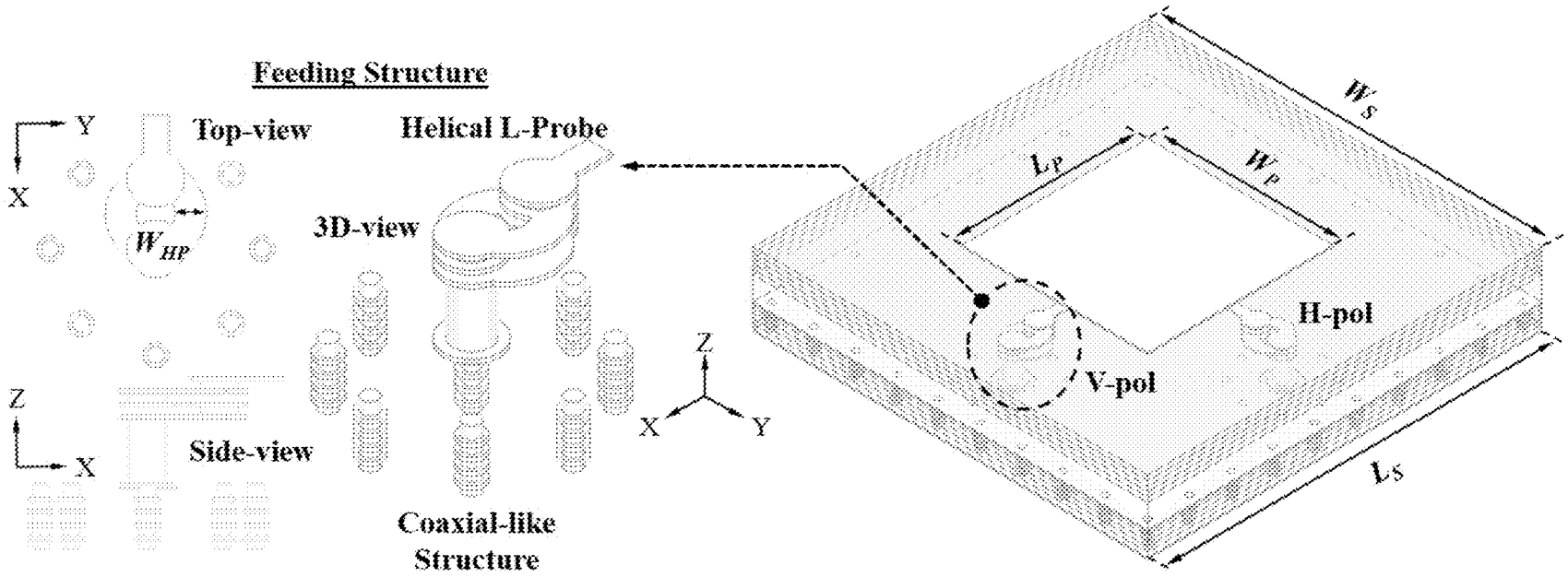
FIGS. 1A and 1B illustrate dimensions and geometry of exemplary embodiments of a wideband dual-polarized 5G antenna element.
Figure 1B:
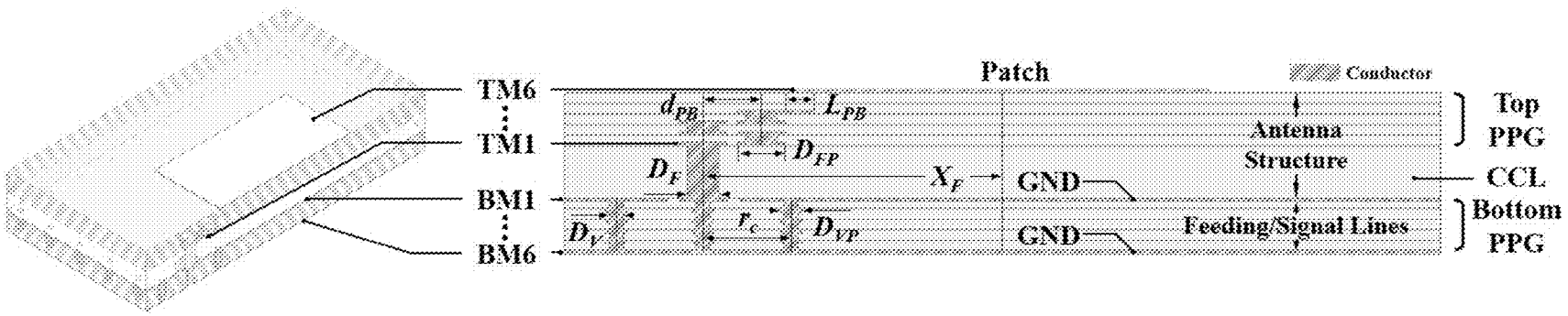

Described herein are embodiments of a wideband polarized patch antenna and the antenna array that can cover mmWave frequency bands 5G applications. In some instances, the antenna may be dual-polarized. One embodiment of a single element of dual-polarized helical-shaped L-probe fed patch antenna (HLF-PA) package is illustrated in FIGS. 1A and 1B. This embodiment of an antenna package comprises a high-density interconnected (HDI) FR-4 printed circuit board (PCB) substrate, which has a dielectric constant ($\varepsilon_r$) of 4.02 and a dielectric loss tangent (tan $\delta_\varepsilon$) of 0.018 at 30 GHz. The element antenna package is comprised of a copper-clad laminates (CCL) layer with thickness ($t_{CCL}$) of 0.3 mm, 10 layers of prepregs (PPG) with a thickness ($t_{PPG}$) of 60 μm, and 12 layers of metal with a thickness ($t_{Cu}$) of 20 μm. Copper is used for all metal layers. The CCL, five top PPG, and six top metal (TM) layers were used for patch antenna structure (antenna portion in AiP), and five bottom PPG and six bottom metal (BM) layers were used for feeding lines. It is to be appreciated that this is just an example of one embodiment, and that the scope of this disclosure is intended to cover other aspects, including, for example, different types of materials, different numbers of layers and/or arrangement of the layers, different material thicknesses and/or dimensions, and the like. In other instances, different substrate materials can be used. For example, a variety of substrate materials can be used not only organic high-density interconnect (HDI) substrates but liquid crystal polymer-based board, glass substrates, high-(HTCC) and low-temperature co-fired ceramic (LTCC) substrates, silicon substrates, and the like. In the case of dielectric loss tangent of substrate materials, smaller values are preferred, since antenna radiation efficiency can be improved with lower loss tangent. Furthermore, either cored or coreless PCBs may be used.

The patch radiator is located on the TM6 layer. Coaxial-like feeding line structures are implemented through metal layers (e.g., from BM1 to BM6) to match the impedance, and helical-shaped L-probe feeding structures (see FIG. 1B) are connected between layers (e.g., BM1 and TM4 metal layers). L-probe feeding methods are generally known to broaden the impedance bandwidth. However, to achieve high performance of the L-probe fed antenna, the length of the L-probe is in the range from 0.2 $\lambda_{ceff}$ to 0.25 $\lambda_{ceff}$ ($\lambda_{ceff}$ is the effective wavelength at the center frequency). In one example, the thickness of AiP is less than 1 mm for mmWave applications. Furthermore, the number of layers for antenna structure is limited, and height for the antenna ($H_{ant}$) becomes less than $0.05\lambda_L$, which is equivalent to 0.54 mm at 28 GHz. For this reason, the conventional L-probe feeding method is not suitable for AiP at 28 GHz bands.

FIG. 1A shows an embodiment of a helical-shaped L-probe feeding structure, which provides wide impedance bandwidth. The designed feeding structure is comprised of a vertical component, which has the helical winding structure with 1.5 number of turns and is connected between BM1 to TM3, and a horizontal component, which is located at TM4. Two helical-shaped L-probe feeding structures are placed orthogonally to realize dual-polarization. Detailed antenna dimensions for one embodiment are summarized in Table I, below.

TABLE I

Dimensions of invented wideband dual-polarized 5 G antenna structure.

| $L_S$ | $W_S$ | $L_P$ | $W_P$ | $L_{PB}$ | $D_F$ | $D_{FP}$ | $d_{PB}$ | $W_{HP}$ |
|---|---|---|---|---|---|---|---|---|
| 5 | 5 | 2.35 | 2.35 | 0.18 | 0.09 | 0.135 | 0.33 | 0.145 |
| $X_F$ | $D_V$ | $D_{VP}$ | $r_c$ | $t_{PPG}$ | $t_{CCL}$ | $t_{Cu}$ | Unit in mm | |
| 1.705 | 0.04 | 0.06 | 0.5 | 0.06 | 0.3 | 0.02 | | |

EXAMPLES

Figure 2A:
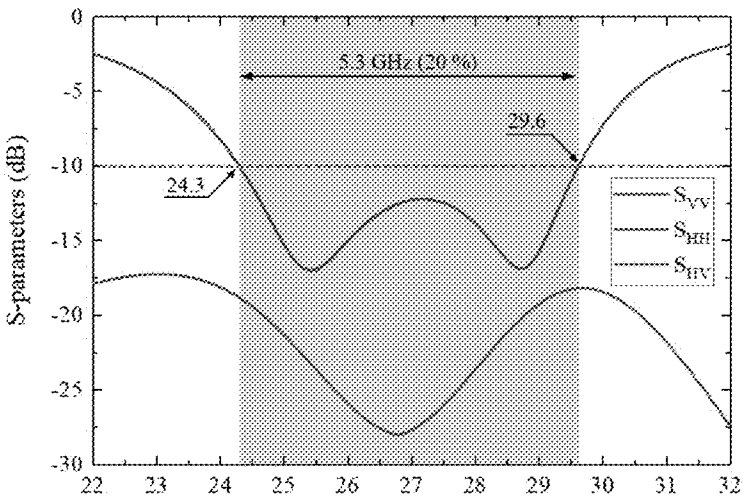
FIGS. 2A and 2B illustrate antenna performance of an exemplary wideband dual-polarized 5G antenna element where
Figure 2B:
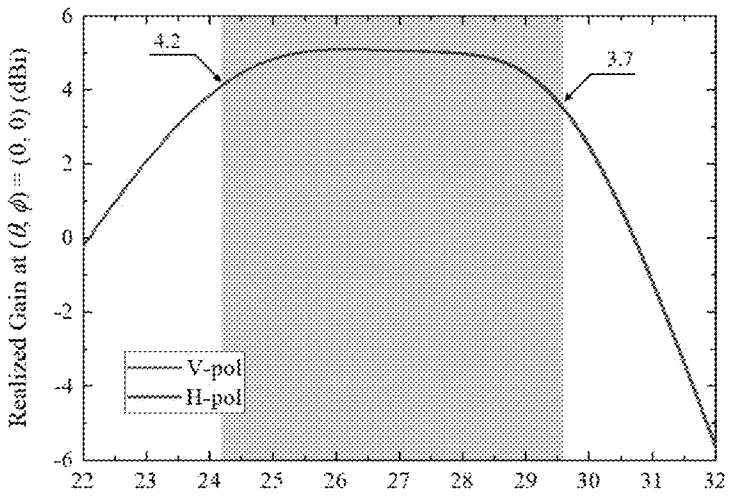
Figure 3B:
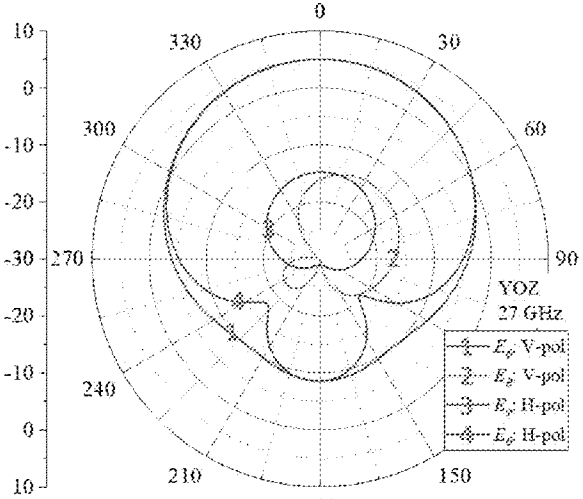
FIGS. 3A and 3B illustrate simulated antenna radiation pattern at 27 GHz where
Figure 3A:
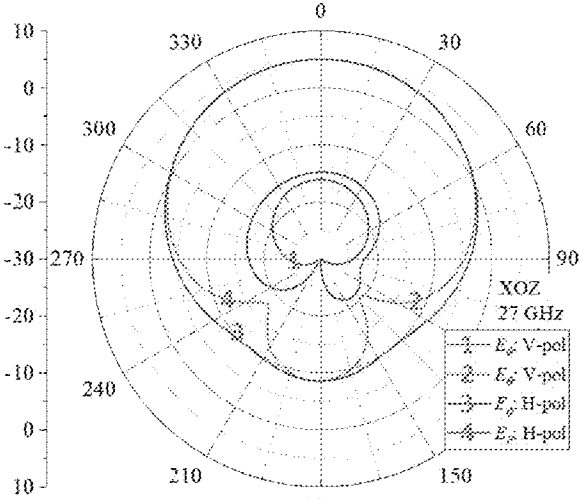

Performance of the exemplary antenna package was simulated with the ANSYS high-frequency structure simulator (HFSS v.18.1). FIG. 2A shows the simulated frequency-dependent S-parameters of the invented HLF-PA element. The 10-dB impedance bandwidth of the both V- and H-ports are 20% (5.3 GHz: 24.3-29.6 GHz). The developed antenna shows good isolation ($|S_{HV}|$) between V- and H-ports greater than 18 dB. The simulated frequency-dependent realized gain at the boresight (RGoo) is the same for both V- and H-ports in FIG. 2B. The simulated minimum and maximum $RG_{00}$ in the operation frequency bands (24.3-29.6 GHz) are 3.7 and 5.1 dBi, respectively. FIGS. 3A and 3B show the simulated radiation patterns at 27 GHz in XOZ- and YOZ-planes. Both maximum gains appear at the boresight. The co-polarized radiation for V-port ($E_\theta$in XOZ-plane and $E_\Phi$in YOZ-plane) is orthogonal to the co-polarized radiation for H-port ($E_\Phi$in XOZ-plane and $E_\theta$in YOZ-plane) in the same planes, indicating the dual-polarization characteristic of the invented HLF-PA element. Small cross-polarization levels of −20 dB were also obtained from XOZ- and YOZ-planes.

Based on the optimized HLF-PA element, a 2 by 4 HLF-PA array (HLF-PAA) was designed and simulated for antenna performance.

Figure 4:
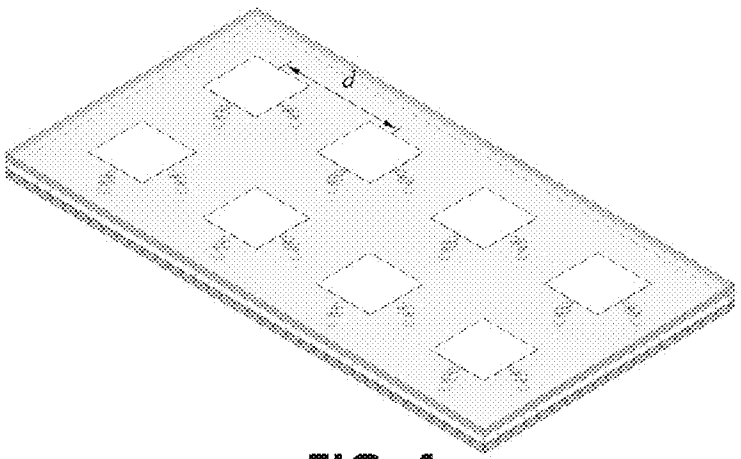
FIG. 4 is an illustration of an exemplary 2 by 4 wideband dual-polarized 5G antenna array.
Figure 5B:
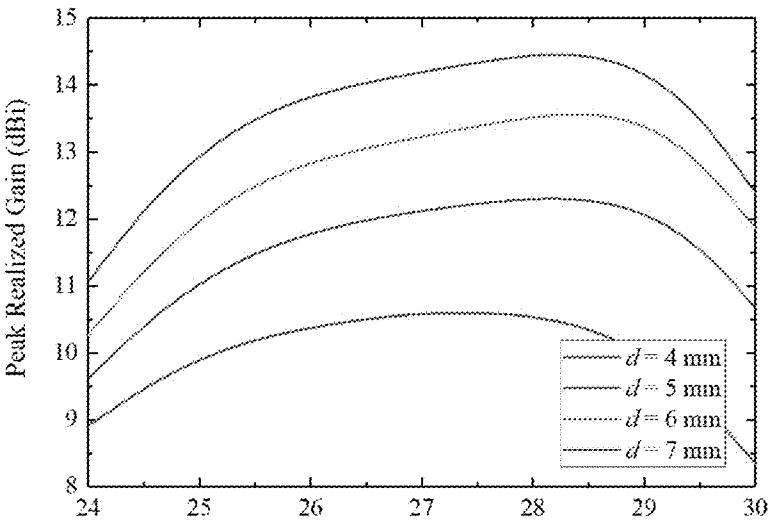
FIGS. 5A and 5B illustrate simulated antenna performance of the array shown in FIG. 4 where
Figure 5A:
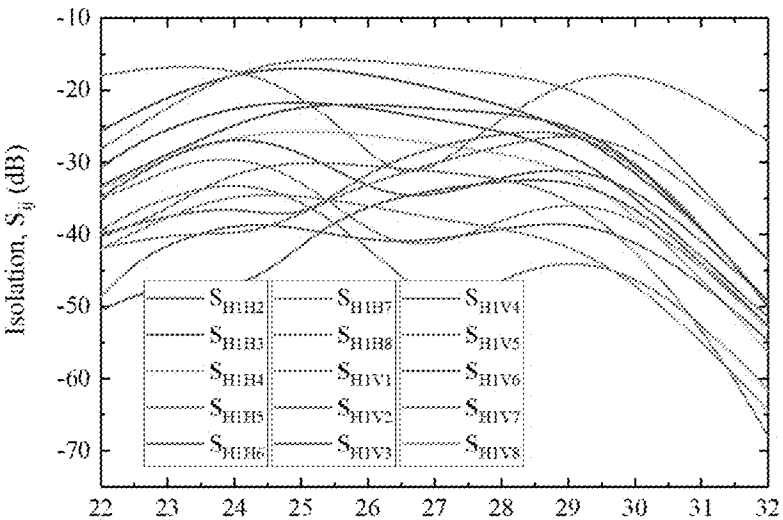
Figure 6B:
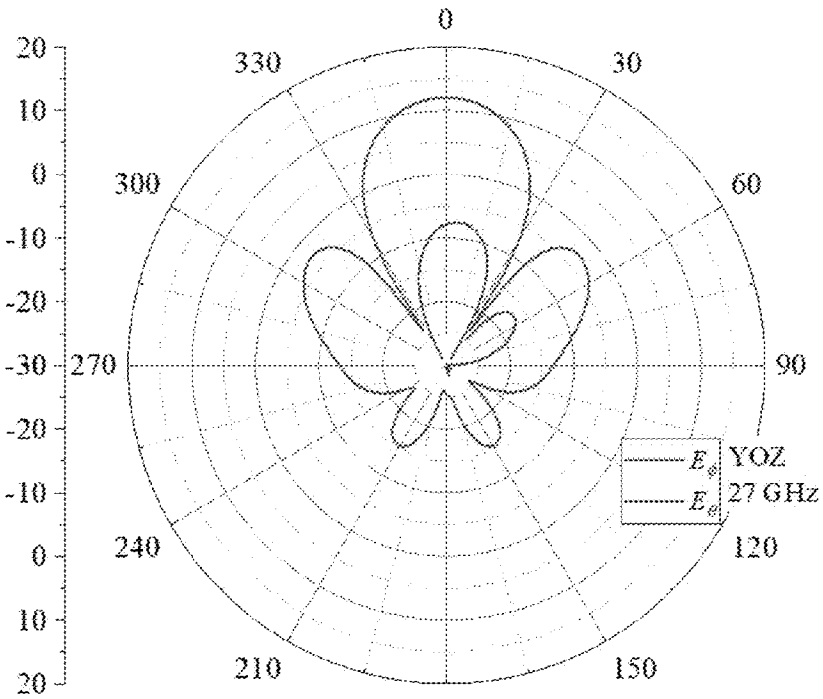
FIGS. 6A-6B illustrate simulated antenna radiation patterns of a wideband 5G antenna array such as that shown in FIG. 4 (with d=5 mm) at 27 GHz where
Figure 6A:
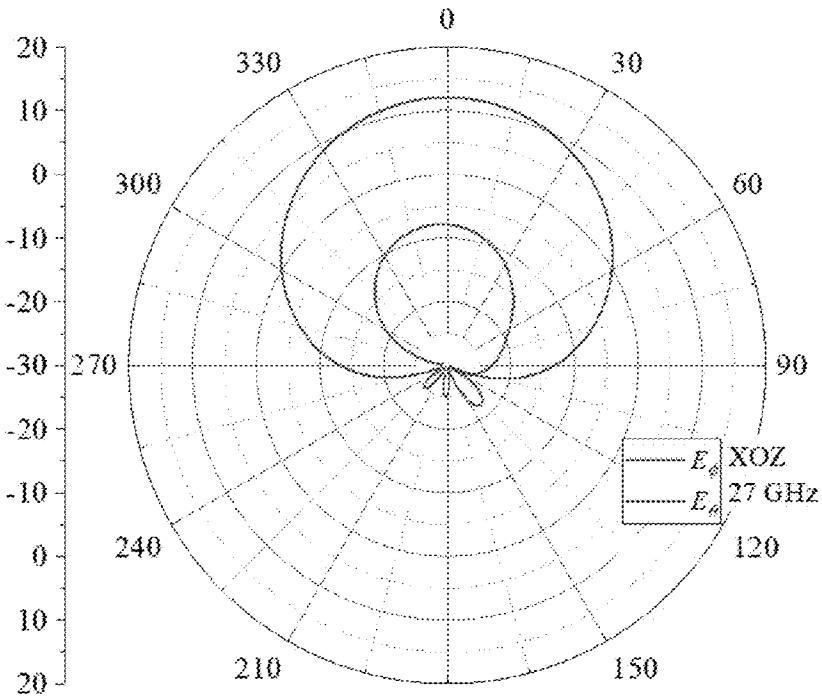

FIG. 4 is an illustration of an exemplary developed 2 by 4 HLF-PAA. The antenna performance of the the shown HLF-PAA was simulated with HFSS v.18.1. The simulated frequency dependent isolation between different ports of the 2 by 4 HLF-PAA with the distance between adjacent elements (d) of 5 mm is shown in FIG. 5A. Isolations $|S_{ij}|$ between two ports are higher than 15 dB. FIG. 5B shows the frequency-dependent peak realized gain (PRG) with different d when only V-ports were excited while H-ports were terminated with 50 ohms. The maximum PRG increased from 10.6 to 14.5 dBi as d increased from 4 to 7 mm. As shown in FIGS. 6A and 6B, in the case of d with 5 mm, PRG in the operating frequency band (24.25-29.5 GHz) is in the range from 10 to 12.3 dBi, which meets the minimum required antenna gain for 5G wireless communication. The far-field radiation performance of HLF-PAA with excitation of H-ports showed the identical performance except providing orthogonal co-polarization, indicating polarization diversity of HLF-PAA.

Figure 7A:
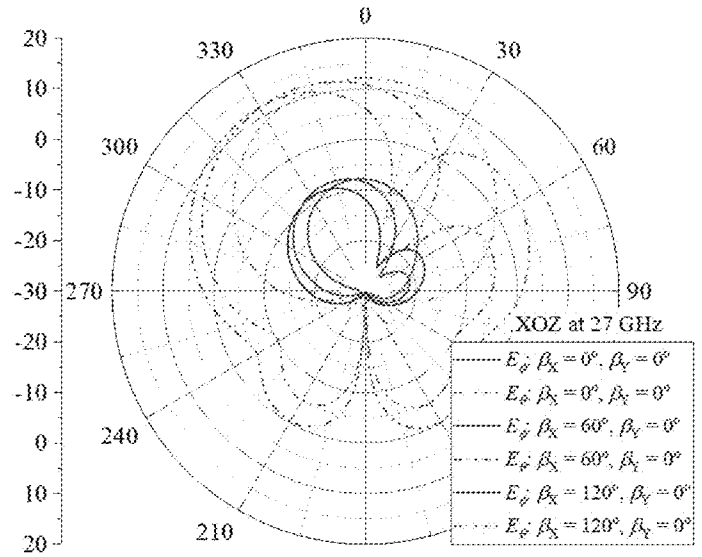
FIGS. 7A-7E illustrate simulated antenna radiation patterns of a wideband 5G antenna array such as that shown in FIG. 4 (with d=5 mm) at 28 GHz with different phase progression (β), where
Figure 7B:
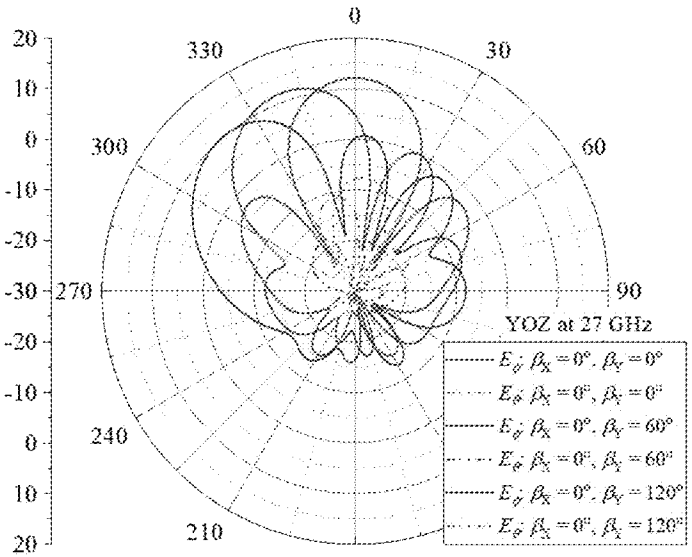
Figure 7C:
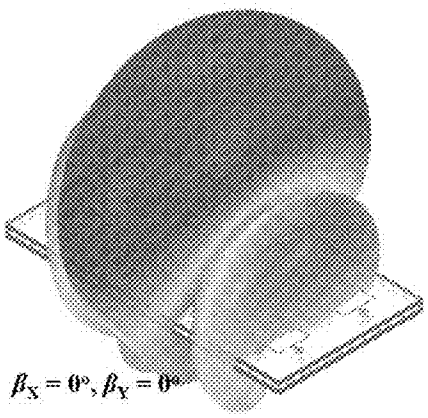
Figure 7D:
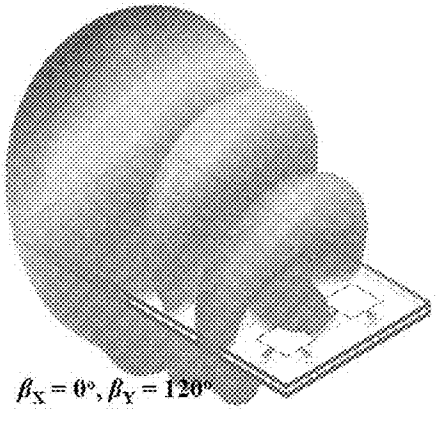
Figure 7E:
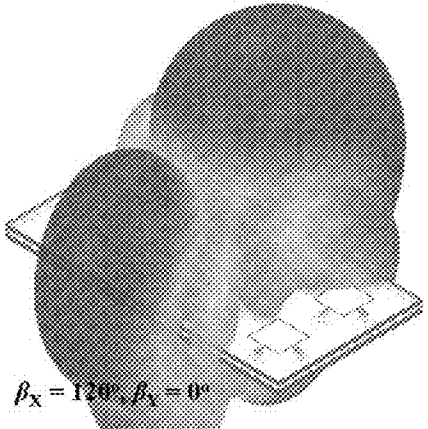

To verify a beamforming capability of HLF-PAA, the phase progression in X- ($\beta_X$) and Y-directions ($\beta_Y$) was varied from 0° to 120° for performance simulation. FIGS. 7A-7E show 2D and 3D radiation patterns of HLF-PAA (only V-ports were excited) at 28 GHz with different $\beta_X$ and $\beta_Y$. The angle for the maximum gain from the radiation pattern in XOZ-plane was steered from 0° to 330° (−30°) as $\beta_X$ varied from 0° to 120° in FIG. 7A. In the case of varying $\beta_Y$ from 0° to 120°, the angle for the maximum gain observed from the radiation pattern in YOZ-plane shifted from 0° to 320° (−40°) as shown in FIG. 7B. HLF-PAA yields a scanning angle up to 60° in X-direction and 80° in Y-direction. PRG slightly decreased from 12.1 to 11.9 dBi and from 12.1 to 10.1 dBi when $\beta_X$ and $\beta_Y$ varied from 0° to 120°, respectively. Also, sidelobe levels (SLLs) were less than −6.6 and −9.3 dB in XOZ- and YOZ-planes, respectively. By comparing 3D radiation patterns in FIGS. 7C, 7D, and 7E, the maximum radiation beam steered in X- and Y-direction by controlling fix and $\beta_Y$, respectively. Comparison of the disclosed HLF-PAA with previously reported antennas for 5G wireless communication is given in Table II. The disclosed HLF-PAA had broader impedance bandwidth (5.3 GHz: 24.3-29.6 GHz) and better antenna gain (>5.1 dBi) than other 5G AiPs with $H_{ant}$ of 0.048 $\lambda_L$. Note that the antenna gain can be further improved by using substrates having low dielectric loss tangent. More importantly, only the disclosed antenna nearly meets the frequency band from 24.25 GHz to 29.5 GHz, which can cover the lower 5G frequency band allocations, while other reported antennas can only operate at a specific country.

TABLE II

Comparison on antenna performance among 28 GHz Antenna-in-Package phased arrays.

| Ref. | Frequency Band (−10 dB Bandwidth) | Each Element Gain | Height for Antenna Part | Remark |
|---|---|---|---|---|
| [2] | 30-30.8 GHz (0.8 GHz: 2.6%) | 3 dBi | N. G. | Dual-pol ($\lvert S_{ij}\rvert$ > 22 dB) |
| [3] | 27.4-29.6 GHz (2.2 GHz: 7.7%) | >4.5 dBi | 490 μm (0.045 $\lambda_L$) | Dual-pol ($\lvert S_{ij}\rvert$: N. G.) |
| [4] | 26.3-30 GHz (3.7 GHz: 13%) | 3-4 dBi | N. G. | Dual-pol ($\lvert S_{ij}\rvert$: N. G.) |
| [5] | 26.5-30.5 GHz (4 GHz: 14%) | N. G. | 540 μm (0.048 $\lambda_L$) | Dual-pol ($\lvert S_{ij}\rvert$ > 17 dB) |
| [6] | 26.4-29.3 GHz (2.9 GHz: 10%) | N. G. | 480 μm (0.042 $\lambda_L$) | Single-pol ($\lvert S_{ij}\rvert$: N. A.) |
| This work | 24.3-29.6 GHz (5.3 GHz: 20%) | 3.7-5.1 dBi | 600 μm (0.048 $\lambda_L$) | Dual-pol ($\lvert S_{ij}\rvert$ > 15 dB) |

N. G.: Not Given

N. A.: Not Applicable $\lambda_L$ is the air wavelength at lowest frequency

CONCLUSION

Disclosed and described herein are embodiments of a dual-polarized helical-shaped L-probe fed patch antenna (HLF-PA) and phased array (HLF-PAA) that cover the 5G frequency band. One antenna embodiment has a wide bandwidth (>5.3 GHz), excellent isolation between V- and H-ports ($\lvert S_{HV}\rvert$>18 dB), and good antenna gain (<5.1 dBi) with small height for antenna portion in the antenna-in-package (AiP). Based on the single element, a 2×4 phased array is described. The exemplary HLF-PAA shows reasonable isolation between ports ($\lvert S_{ij}\rvert$>15 dB) and excellent antenna gain. The exemplary HLF-PAA was capable of beam-forming, which is necessary for 5G wireless communication. Therefore, the developed antenna is applicable for 5G mobile devices.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

Throughout this application, various publications may be referenced. The disclosures of these publications in their entireties are hereby incorporated by reference into this application in order to more fully describe the state of the art to which the methods and systems pertain. These publications include the following, which are each individually incorporated by reference in their entireties:

[1] http://www.rfwireless-world.com/Tutorials/5G-frequency-bands.html

[2] D. Liu, X. Gu, C. W. Baks, and A. Valdes-Garcia, "Antenna-in-Package Design Considerations for Ka-Band 5G Communication Applications," *IEEE Transactions on Antennas and Propagation*, vol. 65, no. 12, pp. 6372-6379, December 2017.

[3] J.-K. Du, K. So, Y. Ra, S.-Y. Jung, J. Kim, S. Y. Kim, S. Woo, H.-T. Kim, Y.-C. Ho, and W. Paik, "Dual-polarized Patch Array Antenna Package for 5G Communication Systems," 11$^{th}$ *European Conference on Antennas and Propagation,* Paris, 2017, pp. 3493-3496.

[4] X. Gu, D. Liu, C. Baks, O. Tageman, B. Sadhu, J. Hallin, L. Rexberg, and A. Valdes-Garcia, "A Multilayer Organic Package with 64 Dual-Polarized Antennas for 28 GHz 5G Communication," *IEEE MTT-S International Microwave Symposium*, Honolulu, Hi., 2017, pp. 1899-1901.

[5] B. Wu, "Advanced Interconnect and Antenna-in-Package Design for Millimeter-wave 5G Communications," 18$^{th}$ *International Conference on Electronic Packaging Technology,* Harbin, 2017, pp. 17-19.

[6] G. Guo, L.-S. Wu, Y.-P. Zhang, and J.-F. Mao, "Stacked Patch Array in LTCC for 28 GHz Antenna-in-Package Applications," *IEEE Electrical Design of Advanced Packaging and Systems Symposium*, Haining, 2017, pp. 1-3.

[7] W. Hong, K.-H. Baek, and A. Goudelev, "Grid Assembly-Free 60-GHz Antenna Module Embedded in FR-4

Transceiver Carrier Board," *IEEE Transactions on Antennas and Propagation, vol.* 61, no. 4, pp. 1573-1580, April 2013.

[8] C. L. Mak, K. M. Luk, K. F. Lee, and Y. L. Chow, "Experimental Study of a Microstrip Patch Antenna with an L-Shaped Probe," *IEEE Transactions on Antennas and Propagation*, vol. 48, no. 5, pp. 777-783, 2000.

[9] P. Li, K. M. Luk, and K. L. Lau, "A Dual-Feed Dual-Band L-Probe Patch Antenna," *IEEE Transactions on Antennas and Propagation*, vol. 53, no. 7, pp. 2321-2323, 2005.

[10] C. A. Balanis, *Antenna Theory: Analysis and Design,* 3rd ed., Hoboken, N.J.: John Wiley & Sons, 2005.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A polarized helical-shaped L-probe fed patch antenna comprising:

a substrate;

a copper-clad laminates (CCL) layer;

a plurality of layers of prepregs (PPG), wherein a portion of the plurality of layers of PPG are below the CCL layer and a portion of the plurality of layers of PPG are above the CCL;

a plurality of metal layers, wherein a portion of the plurality of metal layers are below the CCL layer and comprise bottom metal (BM) layers, and a portion of the plurality of metal layers are above the CCL and comprise top metal (TM) layers, wherein each metal layer is sandwiched between two PPG layers, between a PPG layer and the CCL layer, between the substrate and a PPG layer, or on top of a PPG layer, wherein the CCL, the portion of the plurality of layers of PPG that are above the CCL, and the (TM) layers above the CCL comprise a patch antenna structure and the portion of the plurality of layers of PPG, and the (BM) layers below the CCL comprise feeding lines;

a patch radiator located on one of the TM layers; and one or more helical-shaped L-probe feeding structures, wherein each structure comprises a vertical component having a helical winding structure, a horizontal component, and one or more coaxial-like feeding line structures, wherein the one or more coaxial-like feeding line structures are implemented between metal layers to match impedance and the one or more helical-shaped L-probe feeding structures are also connected between metal layers.

2. The antenna of claim 1, wherein the antenna is dual-polarized.

3. The antenna of claim 2, wherein the antenna comprises two helical-shaped L-probe feeding structures that are placed orthogonally to realize dual-polarization.

4. The antenna of claim 1, wherein copper (Cu) is used for all metal layers.

5. The antenna of claim 1, wherein a length of the horizontal component of the one or more L-probe feeding structures is in a range from 0.1 $\lambda_{ceff}$ to 0.4 $\lambda_{ceff}$, where $\lambda_{ceff}$ is an effective wavelength at a center frequency.

6. The antenna of claim 1, wherein the helical winding structure of each of the one or more of the helical-shaped L-probe feeding structures has a number of turns and is connected between metal layers.

7. The antenna of claim 6, wherein the number of turns is 1.5.

8. The antenna of claim 1, wherein the patch radiator can be in different shapes including circular, triangular, square, and rectangular.

9. The antenna of claim 1, wherein the helical winding structure can be in different shapes including circular, triangular, square, and rectangular.

10. The antenna of claim 1, wherein the antenna has a thickness of less than 1 mm.

11. The antenna of claim 10, wherein the antenna has a thickness of 0.54 mm.

12. The antenna of claim 1, wherein the antenna has a frequency band of 24.3-29.6 GHz.

13. A polarized helical-shaped L-probe fed patch antenna array comprising a plurality of dual-polarized helical-shaped L-probe fed patch antennas, said array comprising:

a substrate;

a copper-clad laminates (CCL) layer;

a plurality of layers of prepregs (PPG), wherein a portion of the plurality of layers of PPG are below the CCL layer and a portion of the plurality of layers of PPG are above the CCL;

a plurality of metal layers, wherein a portion of the plurality of metal layers are below the CCL layer and comprise bottom metal (BM) layers, and a portion of the plurality of metal layers are above the CCL and comprise top metal (TM) layers wherein each metal layer is sandwiched between two PPG layers, between a PPG layer and the CCL layer, between the substrate and a PPG layer, or on top of a PPG layer, wherein the CCL, the portion of the plurality of layers of PPG that are above the CCL, and the (TM) layers above the CCL comprise a patch antenna structure and the portion of the plurality of layers of PPG, and the (BM) layers below the CCL comprise feeding lines;

a plurality of patch radiators located on one of the TM layers;

one or more helical-shaped L-probe feeding structures associated with each patch radiator, wherein each structure comprises a vertical component having a helical winding structure, a horizontal component, and one or more coaxial-like feeding line structures, wherein the one or more coaxial-like feeding line structures are implemented between metal layers to match impedance and each of the one or more helical-shaped L-probe feeding structures associated with each patch radiator is also connected between metal layers.

14. The antenna array of claim 13, wherein copper (Cu) is used for all metal layers.

15. The antenna array of claim 13, wherein a length of the horizontal component of the L-probe feeding structure is in a range from 0.1 λceff to 0.4 λceff, where λceff is an effective wavelength at a center frequency.

16. The antenna array of claim 13, wherein the helical winding structure of each of the one or more helical-shaped L-probe feeding structures associated with each patch radiator has a number of turns and is connected between metal layers.

17. The antenna array of claim 16, wherein the number of turns is 1.5.

18. The antenna array of claim 13, wherein the each of plurality of patch radiators can be in different shapes including circular, triangular, square, and rectangular.

19. The antenna array of claim 13, wherein each of the one or more helical winding structures associated with each patch radiator can be in different shapes including circular, triangular, square, and rectangular.

20. The antenna array of claim 13, wherein the antenna has a thickness of less than 1 mm.

21. The antenna array of claim 20, wherein the antenna has a thickness of 0.54 mm.

22. The antenna array of claim 13, wherein each antenna comprises two helical-shaped L-probe feeding structures associated with each patch radiator and the two helical-shaped L-probe feeding structures are placed orthogonally to realize dual-polarization.

23. The antenna array of claim 13, comprising 8 dual-polarized helical-shaped L-probe fed patch antennas arranged in a 2×4 pattern.

24. The antenna array of claim 23, wherein the antenna array comprises a 2 by 4 wideband dual-polarized 5G antenna array.

25. The antenna of claim 13, wherein the antenna array has a frequency band of 24.3-29.6 GHz.

* * * * *